United States Patent [19]

Schuh

[11] 4,236,936

[45] Dec. 2, 1980

[54] METHOD FOR CLEANING ARTICLES BY SPRAYING

[76] Inventor: Ernst Schuh, Lugstr. 26, 7120 Bietigheim-Bissingen, Fed. Rep. of Germany

[21] Appl. No.: 13,485

[22] Filed: Feb. 21, 1979

[51] Int. Cl.[3] ..... B08B 3/02

[52] U.S. Cl. ..... 134/7; 51/322; 134/9; 134/15; 134/18

[58] Field of Search ..... 134/7, 9, 15, 18, 56 R, 134/57 R, 115 R, 122; 51/165.73, 322; 29/81 B

[56] References Cited

U.S. PATENT DOCUMENTS

| | | | |
|---|---|---|---|
| 2,158,063 | 5/1939 | Broadfield | 51/322 X |
| 2,427,064 | 9/1945 | Moul | 51/322 X |
| 2,821,492 | 1/1958 | Berdis | 134/18 X |
| 3,824,739 | 7/1974 | Moret et al. | 51/322 X |

FOREIGN PATENT DOCUMENTS

| | | | |
|---|---|---|---|
| 2011049 | 9/1971 | Fed. Rep. of Germany | 51/165.73 |

*Primary Examiner*—Marc L. Caroff

*Attorney, Agent, or Firm*—Reising, Ethington, Barnard, Perry & Brooks

[57] ABSTRACT

In order to obtain a high degree of efficiency of spraying of articles, e.g. wires, which travel singly or in groups through a spray zone of a spraying apparatus for cleaning their surfaces, the surface temperature of the articles, produced by the impact of the particles of the spray medium, is measured after their passage through the spray zone. Thereafter, in accordance with the temperature measured, the articles are displaced in the spray zone in a direction transverse to their direction of travel until the measured temperature substantially reaches a maximum.

12 Claims, 7 Drawing Figures

METHOD FOR CLEANING ARTICLES BY SPRAYING

The invention relates to a method of obtaining a high degree of efficiency of spraying of articles which travel through the spray zone of spray jet apparatus for cleaning their surfaces, as well as apparatus for performing this method.

The spraying process proceeding within the spray zone of known spraying apparatus for producing bright metal surfaces on articles to be sprayed cannot be controlled in the operative region of the spray jets because of the abrasive effect of the particles of the spray medium, in the manner that the articles remain continuously within the optimum effective range of the spray jets while they travel through the spray zone; on the contrary the articles are diverted by the force of the spray jet or jets from the travelling line which guarantees an optimum degree of efficiency, and a strong reduction of the cleaning effect results.

Owing to the strong abrasive effect of the spray jets and because of the spread of the spraying medium particles, visual observation of the direct effects of the spray jet on the articles for the purpose of performing a correction of the travelling direction is impossible. Likewise sensors for the continuous control of the process cannot be placed within the spray zone.

An object of the invention is a method which renders possible process control for obtaining a high degree of efficiency of spraying.

The present invention provides a method of obtaining a high degree of efficiency of spray jets to articles which travel through the spray zone of spraying apparatus for their surfaces to be cleaned, in which after the passage through the spray zone the surface temperature of the articles produced by the impact energy of the particles of the spray medium is detected and thereafter, in accordance with the temperature detected, the articles in the spray zone are displaced in a direction transverse to their direction of movement until they have at least approximately the attainable maximum temperature.

Thus the invention utilises the surface temperature of the articles issuing from the spray zone as a guide value for the displacement thereof to be performed transverse to their direction of movement for the purpose of increasing the degree of efficiency of spraying.

The necessary transverse displacement may be performed manually; however, it is considerably more favourable if the surface temperature is determined in a contact-less manner and the displacement of the articles is effected in accordance with the temperature change, whereby it is ensured that a transverse displacement necessary for attaining the obtainable maximum temperature occurs even at small temperature deviations.

The method according to the invention is not limited to the guidance of flexible or rigid elongate members through the spray zone of spray apparatus, but is suitable in the same advantageous manner for the spray treatment of workpieces which, hanging one behind the other, travel individually through the spray zone.

If the article to be treated is an elongate member, e.g. a material in the form of a wire, chain, or rod, travelling through the spray zone and for the treatment thereof one spray jet or two spray jets located relatively to each other at an angular spacing of preferably 90° and operating in a common plane are directed, it is advantageous to perform the displacement of the article in the spray zone such that the article when subjected to a spray treatment with solely one spray jet is displaced in a temperature dependent manner substantially perpendicularly to the spray direction thereof and in the case of two spray jets, in a plane of approximately 45° relatively to the spray jets.

If more than two elongate members pass through the spray zone, it is usual to subject each elongate member to a separate spray jet. In this case it is advantageous to effect the displacement of the elongate members in such a manner that each elongate member is displaced in a temperature-dependent manner perpendicularly to the spray jet treating it, which means that each elongate member independently of the others, is adjustable into the optimum effective field of the spray jet engaging it.

In a further advantageous embodiment of the method the traction tension of the elongate member or members is adjusted additionally to a predetermined nominal value at least on the length travelling through the spray zone, whereby the deviation of the article away from the axis aimed at within the effective field of the spray jet can be counteracted additionally, in that the amplitude produced under the effect of the spray jet, of the elongate member is kept as small as possible by maintaining the tension at a certain nominal value and thereby effective stabilisation of the article in the spray zone is obtained, which favours considerably the adjustment of the latter article into the optimum effective field of the spray jet or jets, respectively.

The adjustment of this nominal value may be effected in a particularly simple manner if the control quantity required for adjusting the nominal value of the tension is detected by measuring the amplitude of the elongate member produced under the effect of the spray jet. The measuring of the amplitude of the elongate member may be performed for example by means of a capacitative measuring method. However, this is performed preferably by measuring a back pressure produced by an air stream directed at the elongate member in the plane of oscillation thereof.

When spray-testing flexible elongate members, in particular wire, high exploitation of the at least one spray jet may be favoured additionally if the elongate member is diverted in a known manner outside the spray zone and is guided at least once again through the spray zone. In this case the article travels at least twice through the spray zone, the possibility existing at the same time that the article is cooled outside the spray zone.

A further improved spray jet exploitation is obtained if the elongate member is partly twisted within the elastic range prior to a repeated passage through the spray zone. In this way the regions which had not been reached by the spray medium during the first passage through the spray zone are exposed thereto during the repeated through-passage.

In the known spraying apparatus, spray jet focussing has previously constituted a hindrance in as much as, for example, wires having a diameter of less than 4 mm cannot be treated at the pulling through speed of e.g. 5 m/s which is necessary to ensure economic spray treatment.

However, a considerable increase of the feed speeds is possible when a plurality of runs of the elongate member is guided simultaneously through the spray zone, in which case these runs should be twisted accordingly prior to a repeated through-passage. In comparison with a single through-passage of the elongate member through the spray zone, this measure permits without difficulty an 8 to 10 times higher feed speed.

The effect of the particles of the spraying medium in the effective field of the spray jet does not change inconsiderably in the course of time; for example, the guide faces of ejector scoops of thrower wheels become uneven in the course of time. The consequence is a continuous change of the density of the spraying medium within a spray jet and in particular previously focussed spray jets.

Disadvantageous effects of such changes of the density of the spraying medium within spray jets may be avoided particularly simply if a plurality of runs of the elongate member are guided simultaneously through the spray zone, and, for the purpose of focussing the spray jet treating them, the runs are collected to form at least one group and are guided in the operative spray field in a plurality of planes disposed perpendicular to the direction of spraying and at such mutual spacings that, considered in the direction of the spray jet, the runs deflect the spray medium of the spray jet partly in the direction of the other runs associated with this group. In this case the part members located within the spray zone themselves contribute once again to focussing of the spray jet within its effective region, so that a large portion of the spraying medium particles of the respective spray jet affects a plurality of runs; changes of the density of the spraying medium in consequence of corresponding wear of the guide faces of thrower wheels is thus compensated to a high degree.

The above-described method may be performed advantageously by means of apparatus comprising a guiding device which guides either the article or a support member supporting the article and which is displaceable transverse to the feed direction of the article by means of an adjusting device.

It is favourable in this case if the guiding device comprises a temperature feeler for measuring the surface temperature of the article and the adjusting device comprises an adjuster element which is drivable by hand as well as by an electro-motor, so that the adjustment of the article can be effected as close as possible into the optimum effective field, corresponding to the highest temperature shading, at any time, by hand, if the electric drive or the components serving for the control thereof should fail by chance.

For the controlled adjustment of the article into the optimum feed-through position within the spray zone it is favourable in this case if the guiding device comprises at least one guide element in front of the entry of the article into the spray zone and after the exit thereof out of the latter, the guide element present at the exit and supporting the temperature feeler, and at least this one being displaceable transversely to the feed direction of the article.

If by means of the method a flexible elongate member, in particular a wire, is to be spray-treated and for this purpose is diverted outside the spray zone and guided at least once more through the spray zone, it is favourable to provide for this purpose in a known manner at least one respective guide disc in front of the inlet and behind the outlet of the spray zone the axis of rotation of which is arranged preferably inclined in space and transverse to the feed direction of the elongate member in such a manner that a peripheral part of the guide discs is located substantially in the plane in front of the inlet or behind the outlet, respectively, of the spray zone. Owing to this kind of deviation and return guidance of the elongate member outside the spraying arrangement additional seals are avoided, and guide discs may be used which have a relatively large diameter of, for example, from approximately 0.8 to 1.5 m.

It is advantageous in this case if in front of the inlet of the spray zone a control device is provided for adjusting a predetermined nominal value of the tension of the elongate member which permits the formation of the amplitude of the elongate member to be monitored which is produced by the at least one spray jet. Here the following advantages are obtained: because of the fact that the elongate member is drawn off a reel and pulled several times through the spray zone by means of the drivable guide disc, a re-forming machine connected beyond the spray zone is relieved of this drawing work. When heretofore elongate members were conveyed several times through the spray zone of a spray apparatus, the articles had to be drawn through the spray apparatus or driven by means of the re-forming machine, so that when the wire cross-section was correspondingly small the wire fractured frequently and with larger wire cross-sections the risk of overloading the re-forming machine existed.

A further advantage of this construction resides in the fact that, in the case of a false control, emergency—OFF, or wire fracture, overshoot travel of the wire is effectively prevented on account of the fact that the wire cores embrace only half the driven guide disc.

Furthermore, the use of one drivable and one brakeable guide disc offers the possibility to match the feed speed to the variable operating speed of the re-forming machine, which can be effected in a simple manner by means of a suitable control, for example a tachodynamo. The tension may be adjusted to a pre-determined nominal value by appropriate regulation of the braking device of the breakable guide disc, in which case the control device regulating the braking device may be a suitable resonance meter, so that the use of a back pressure for detecting the oscillations of the article indicates merely one advantageous possibility in this respect. In this case a preliminary wire straightening device preceding the spray zone may be additionally incorporated in the control as a further pull-back brake. Moreover it may be envisaged in this case to arrange the guide disc preceding the spray zone in a freely rotatable manner or to be able to omit the brakeable construction thereof.

In the case in which the control pulses of the control device are produced by the back pressure of an air stream directed upon the elongate member, it is advisable to construct the braking device so as to be controlled by a control device for the purpose of adjusting the tension of the elongate member to a predetermined nominal value.

In a particularly space-saving arrangement of the guide discs, the control pulses of the control device are producible by the back pressure of an air stream directed to the elongate member, and the braking device of the at least one guide disc arranged in front of the inlet of the spray zone is formed by a brake motor which is controllable by a pressure/tension converter controllable by the back pressure. Owing to this arrangement the space above the spray zone remains free of runs of the elongate member guided back, and the inclined position of the guide discs may be so selected that the runs move along the outside of the spray apparatus immediately adjacent the same. If a plurality of runs are to travel parallel relatively to each other over the guide discs, each of them is advantageously guided in a respective circumferential groove of the guide discs.

In this case the twisting of the runs of the elongate member which are to be guided repeated times through the spray zone may be attained in a particularly simple manner if the at least one run of the elongate member which is guided back outside the spray zone to the inlet thereof by means of the guide discs is located in a plane below the run which enters the spray zone or issues therefrom, respectively. Owing to the guide discs lying relatively to each other in mutually oppositely directed inclined positions, the runs of the elongate member are forcibly twisted in themselves upon transfer from one pair of discs to the other, so that every peripheral portion of the elongate member is exposed at least once during a through-passage to the direct effect of at least one spray jet.

Possible constructional examples of devices for performing the method are diagrammatically illustrated in the accompanying drawing, in which.

Figure 1:
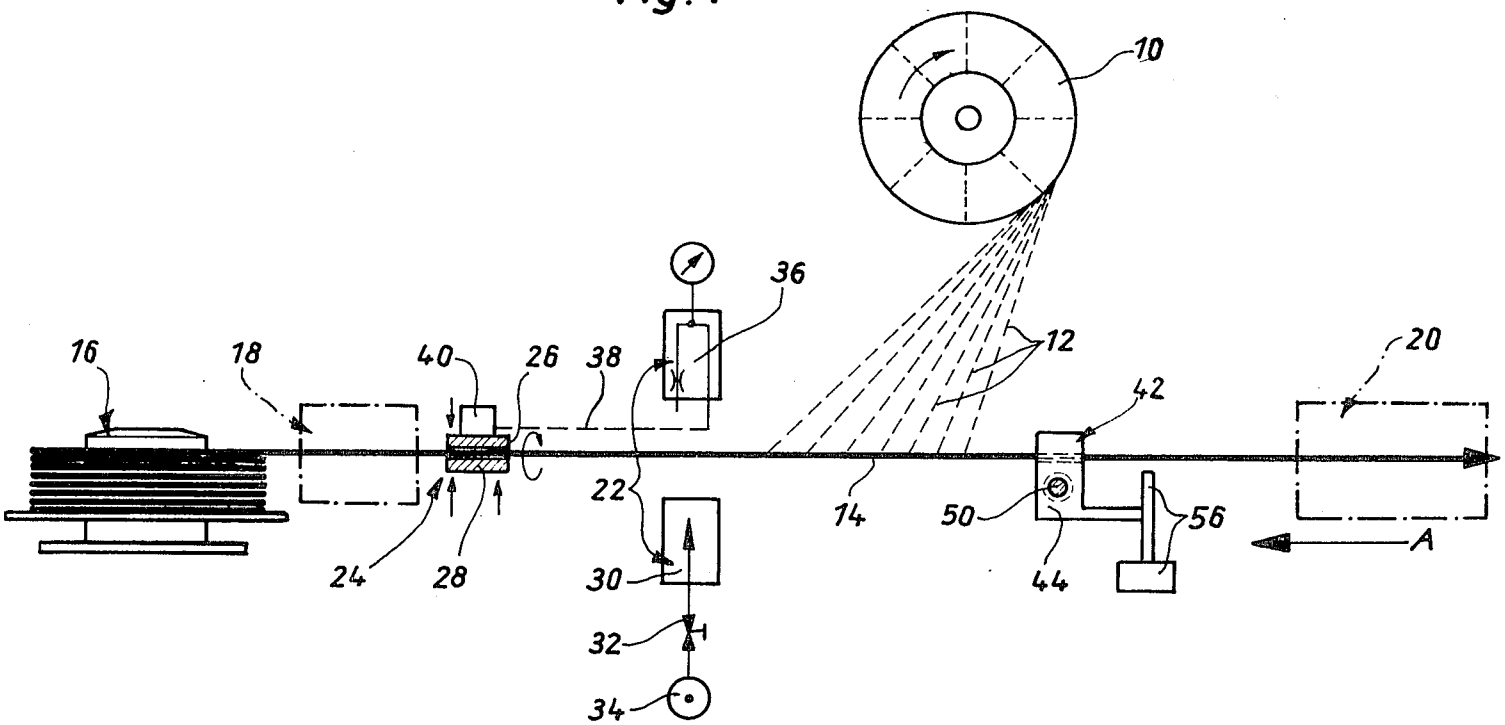
FIG. 1 is a side view of spray-cleaning apparatus in its simplest constructional form.
Figure 2:
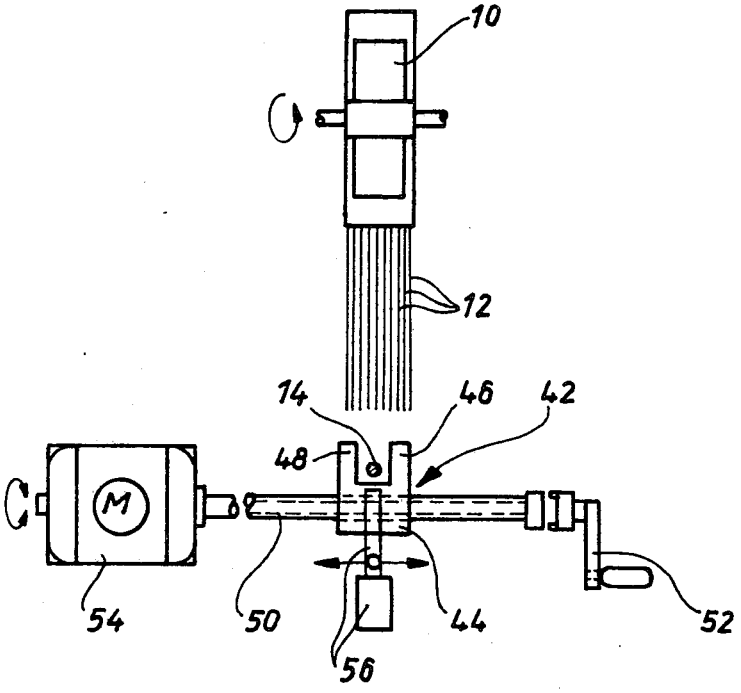
FIG. 2 is a view of the apparatus in the direction of the arrow A of FIG. 1.

In FIGS. 1 and 2 the spray zone of spray apparatus is indicated by a thrower wheel 10 by which a spray jet 12 is projected at an elongate member, in the present case a wire 14, travelling through the spray zone, for the purpose of obtaining a bright metal surface. The spray jet is formed by a spraying medium which has the usual nature and which is ejected from the thrower wheel in the form of a sharply defined directed jet.

The wire is drawn off a reel 16 in the usual manner and preferably straightened by a wire straightening device 18 (indicated in a dash-dotted line) prior to its entry into the spray zone. After its exit from the spray zone the wire travels into a wire re-forming or coiling machine 20 (also indicated in dash-dotted line) before it is manipulated further.

The apparatus comprises a control device 22 which is located in front of the inlet of the spray zone and by means of which a predetermined nominal value of the tension of the wire is controllable and which thus monitors the formation of the amplitude of the wire produced by the spray jet. Accordingly this control device constitutes a resonance meter whose control pulses control a braking device 24 through which the wire is guided after exit from the wire straightening machine 18. For example, the braking device comprises two brake members 26, 28 which clamp the wire between them and which are rotatable perpendicularly to the longitudinal direction of the wire and additionally also about an axis which is parallel to the longitudinal axis of the wire, for the purpose of twisting the wire during its passage through the spray zone.

For example, the control device 22 operates with an air stream which is directed upon the wire by an air nozzle 30 in the plane of oscillation thereof. This air nozzle is connected by way of a valve 32 to a source of compressed air 34. Disposed opposite the air nozzle, on the other side of the wire, is a back pressure nozzle 36 which is in connection with a pressure/tension converter 40 of the braking device 24 through a connecting pipe 38. This converter produces control pulses by which the brake members 26, 28 are moved towards or away from each other in accordance with the back pressure detected, by means of a drive not illustrated in detail, whereby the tension of the wire is adjusted to a predetermined nominal value.

Behind the outlet of the spray zone there is a guiding device 42, by which the wire is displaceable substantially perpendicularly to the spray direction of the spray jet 12. This means in the present case that the wire is displaced perpendicularly to the plane of the drawing.

This device comprise a guide element 44 which guides the wire 14 for example between two limbs 46, 48. The guide element is adjustable for example by means of a screw-threaded spindle 50 in the directions of the arrows indicated in FIG. 2, for which purpose the spindle may be coupled either to a hand crank 52 for manual displacement of the guide member or to an adjuster motor 54 for automatic displacement.

Furthermore, the guide member comprises a temperature measuring device 56 by means of which the surface temperature of the wire is detected in a contact-less manner. The adjuster motor 54 is controllable by means of this temperature measuring device; additionally the surface temperature of the wire can be read off this device.

The manner of working of the apparatus described above is as follows:

When the spray jet 12 is directed upon the wire 14 passing through the spray zone, the wire is deflected as usual by the effect of the impact forces of the spray medium, which means that it is displaced in the effective field of the spray jet in such a manner that the jet is exploited only incompletely and thus its degree of efficiency is highly reduced. This applies in particular to thin wires.

Now, the invention is based on the recognition that the surface temperature of the wire produced by the impact energy of the spray medium particles can be utilised for the adjustment thereof in the region of the effective field of the spray jet so that a high degree of efficiency of spray jets is ensured, in which high operating outputs of the spray jet generate correspondingly high surface temperatures and accordingly a high or optimum degree of efficiency of the spray apparatus is ensured when the wire exhibits the highest obtainable temperature shading.

Accordingly, by means of the guiding device 42 the wire 14 can be adjusted either continuously by the adjuster motor 54 or manually to an optimum conveyance position within the spray zone, in that the surface temperature of the wire is detected by means of the temperature measuring device 56 and thereafter, corresponding to the temperature detected, the article in the spray zone is displaced in a direction transverse to the direction of the spray jet until the wire exhibits at least approximately the obtainable maximum temperature. The method according to the invention or the apparatus described, respectively, utilises therefore as a control quantity or parameter for the adjustment of the wire into the conveyance position referred to, the surface temperature of the wire.

The braking device 24 controlled by the control device 22 offers moreover the possibility to maintain the amplitude of the vibrations of the wire (produced by the effect of the spray jet) as small as possible by tensioning the wire, which likewise counteracts escape of the wire from the region of the effective spray jet field, thus ensuring a high degree of efficiency.

Figure 3:
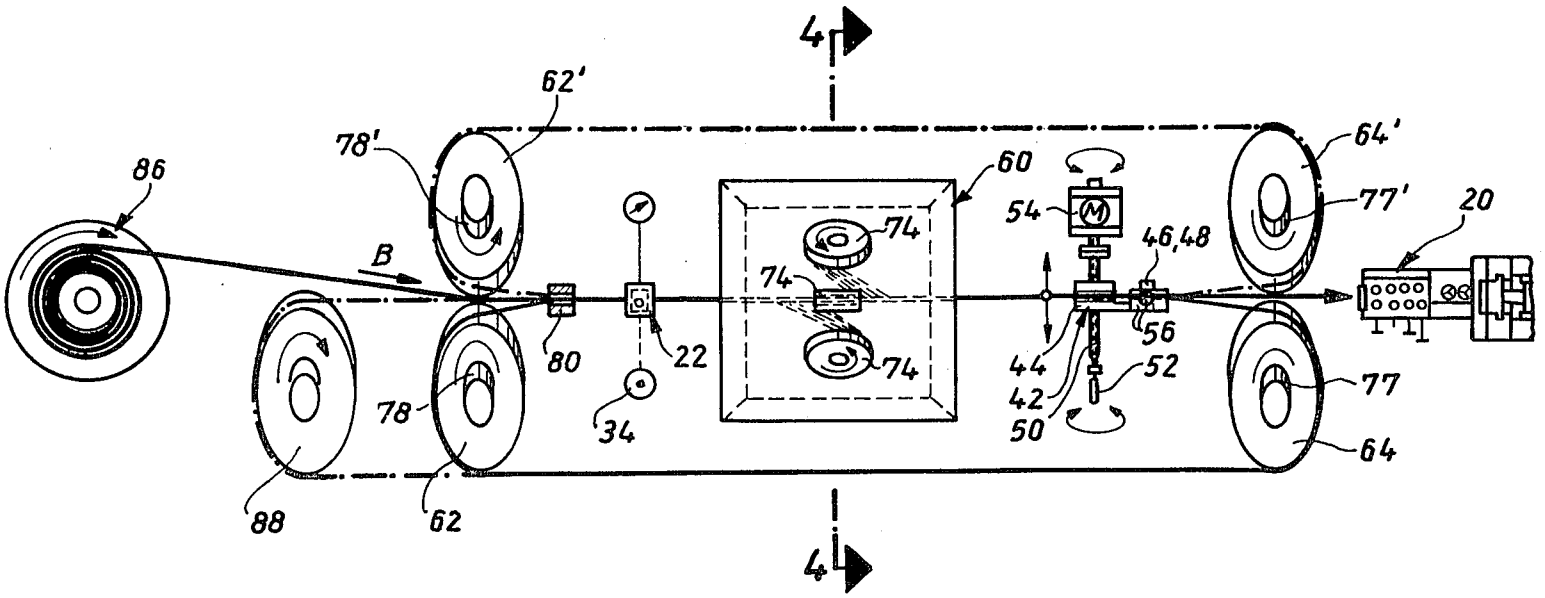
FIG. 3 is a plan view of a further constructional example of apparatus, in which a plurality of runs of an elongate member are guided through the spray zone of a spray apparatus, wherein for simplicity only one run of the elongate member is shown.

The apparatus illustrated in FIG. 3 in conjunction with a spray apparatus 60 serves e.g. for guiding a wire several times through the spray zone, in order to increase the cleaning degree even further.

Figure 6:
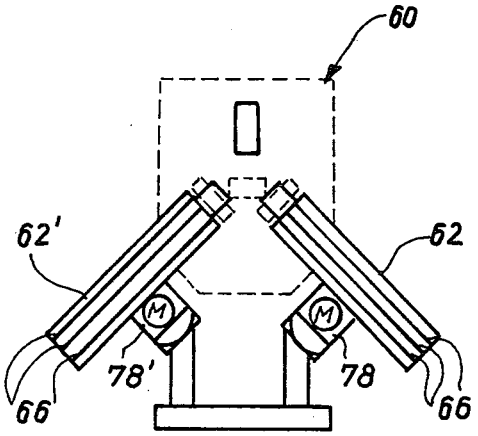
FIG. 6 is a view of the apparatus according to FIG. 3 considered in the direction of the arrow B in FIG. 3.

For this purpose, a respective pair of guide discs 62, 62' or 64, 64', respectively, are arranged in the region in front of inlet and behind the outlet, respectively, of the spray zone; the axes of rotation thereof are arranged inclined in space and transverse to the feed direction of the wire, the arrangement of the guide discs being such that a peripheral portion thereof is located substantially in the plane in front of the inlet and behind the outlet, respectively, of the spray zone, and the guide discs are arranged substantially symmetrically in relation to the respective inlet and outlet (see FIG. 6). The guide discs comprise at the periphery circumferential grooves 66 in which the wire is guided several times. Thereby the wire is first guided for example with two runs on the guide discs 62, 64; after travelling through the spray zone and after running off the guide disc 62 the wire is diverted on to the guide disc 62' and guided back over the guide disc 64' outside the spray zone and guided again through the latter.

Figure 4:
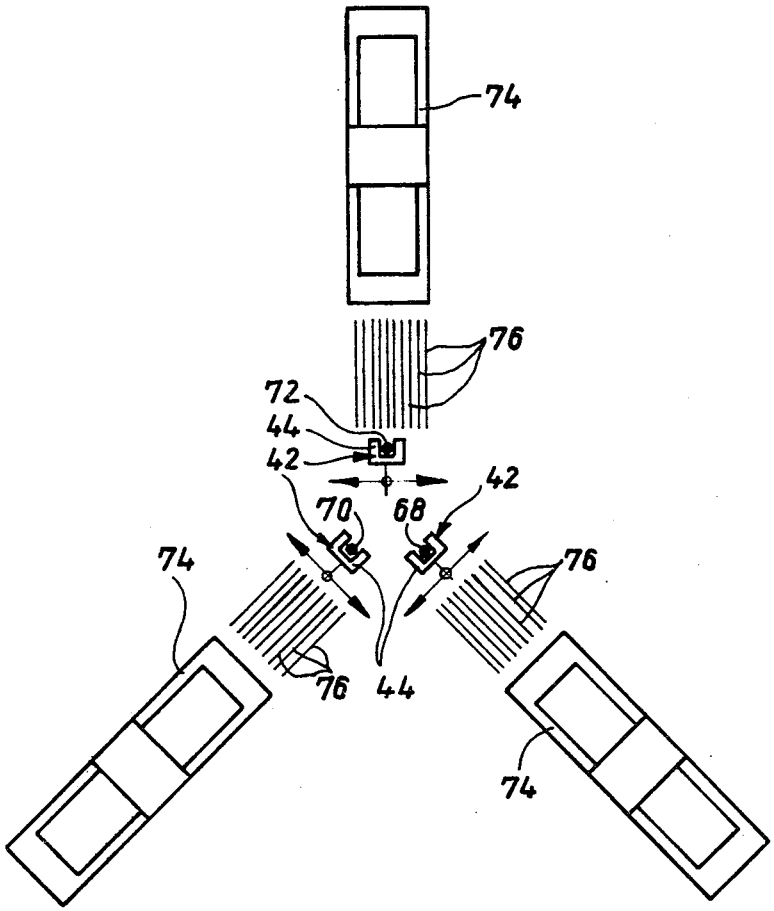
FIG. 4 is a cross-section through the spray zone on the line 4—4 of FIG. 3.

In this case e.g. three wire runs 68, 70, 72 (see FIG. 4) are thus located simultaneously in the spray zone, a separate spray jet 76 being directed in this case by means of a thrower wheel 74 upon each wire run. Each wire run is associated with a separate guiding device 42 which is combined with a temperature measuring apparatus, and which as to their construction correspond for example that of FIG. 2, for reasons of clarity merely one guiding device being indicated in FIG. 3. Accordingly, by means of the temperature shading, the individual wire runs by themselves may be adjusted in the manner explained above in relation to the spray jet affecting them, in order to increase the degree of efficiency accordingly. In this construction, too, a braking device fulfills the same task as in the construction according to FIGS. 1 and 2, but with the difference that, owing to the arrangement in pairs of the guide discs, the wire runs are forcibly twisted by the transfer to the various guide discs, so that there is no need for a special operation to twist the wire.

The guide discs 64, 64' provided behind the outlet of the spray zone and behind the guide devices 42, respectively, are drivable by means of a drive motor 77 or 77', respectively, whereas each of the two other guide discs 62, 62' is breakable by a respective brake motor 78 and 78'. Thus the pairs of guide discs form the braking device which is controllable by the control device 22, so that in this constructional form a stationary guide member 80 may take the place of the brake members 26, 28 provided in FIG. 1, for each wire run 68, 70, 72.

Figure 5:
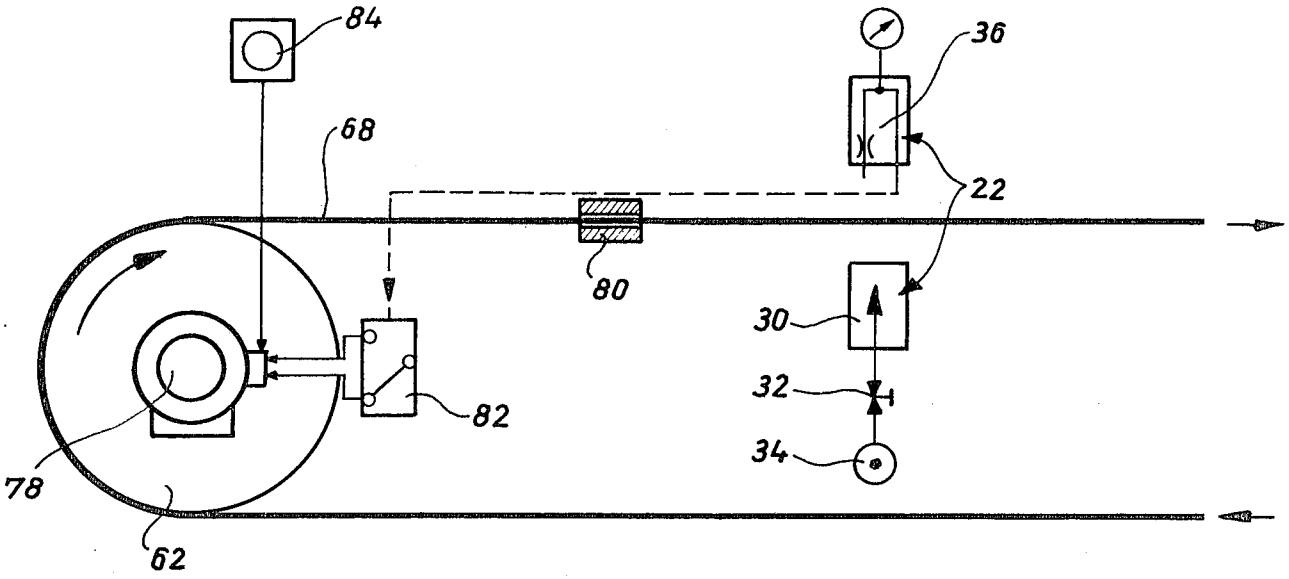
FIG. 5 is a side view of the part of the apparatus of FIG. 3 located in front of the spray zone.

According to FIG. 5, each brake motor 78, 78' is controllable by a pressure/tension converter 82 which is supplied with pulses by the control device 22 by which the back tension of the wire is changed within a predetermined nominal range. Furthermore the pair of guide discs 62, 62' is associated with a transfer disc 88 which is inserted between them and a wire reel 86 and by means of which the wire is transferred from the transfer disc 62 to the transfer disc 62'.

The half-open embrace of the guide discs by the wire ensures that the wire runs do not overrun, e.g. in the case of a wire fracture or a control failure.

The rotary speed of the drivable guide discs 64 and 64' may be synchronised with the re-forming machine 20, so that the conveyance speed of the wire can be matched to the variable operating speed of this machine.

Figure 7:
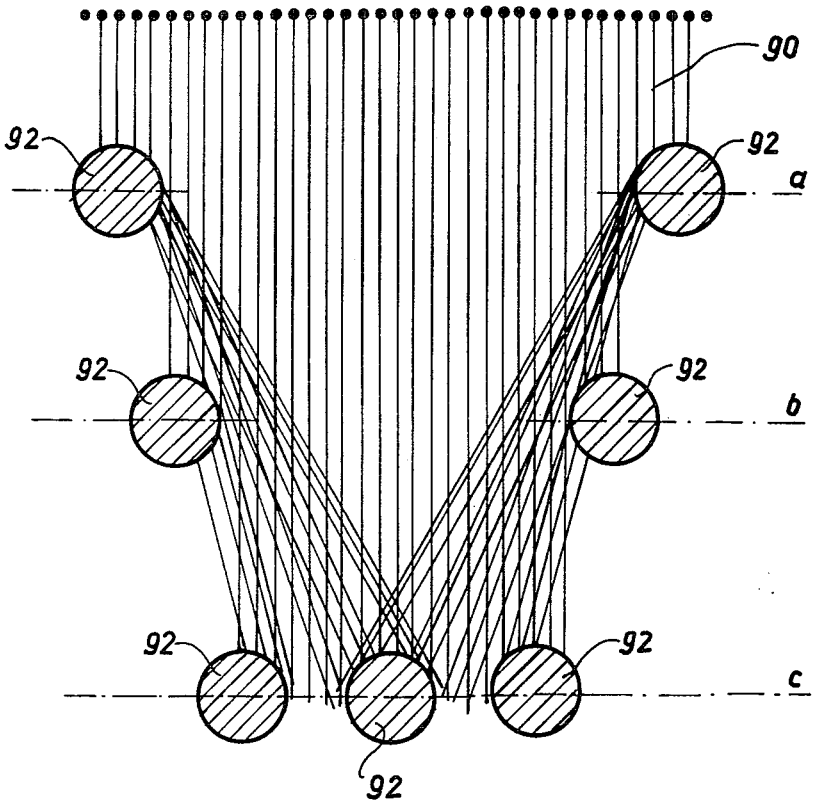
FIG. 7 is a representation of a possible guidance of a plurality of runs of an elongate member relatively to a spray jet treating them.

It is obvious that even more than three wire runs can be guided through the spray zone in the manner described and can be appropriately orientated in the effective field of the spray jets in order to obtain high degree of efficiency. In this case it is possible e.g. to obtain additionally focussing of the spray jets by means of wire guidance according to FIG. 7, in that for each spray jet 90 a group of wire runs 92 are guided in the effective field of the jet in a plurality of planes a, b, c which are disposed perpendicular to the spraying direction, and at such mutual spacings in these planes that, considered in the direction of the spray jet, the wire runs 92 deflect the particles of the spray medium of the spray jet in direction of the other runs associated with this group. In the case of a plurality of spray jets operating in the spray zone, such a group of wire runs associated with each other in this way may be provided for each spray jet.

I claim:

1. A method of spraying surfaces of articles which travel through a spray zone of spraying apparatus for cleaning said surfaces, the method comprising measuring the surface temperature of the articles, produced by the impact energy of the particles of the spray medium, after passage of the articles through the spray zone, and thereafter, in accordance with the temperature measured, displacing the articles in the spray zone in a direction transverse to their direction of travel until they have substantially the maximum surface temperature attainable.

2. A method as claimed in claim 1, in which the surface temperature is determined in a contact-less manner and the displacement of the articles is automatically effected in accordance with the temperature change.

3. A method as claimed in claim 1 or 2, in which the articles are elongate members.

4. A method as claimed in claim 3, in which a spray jet or two spray jets located at a mutual angular spacing of 90° and operating in a common plane are directed to at least one elongate member being fed through the spray zone, and in which the member when subjected to a spray treatment with solely one spray jet is displaced in a temperature dependent manner substantially perpendicular to the spray direction thereof and, in the case of two spray jets, in a plane of approximately 45° relatively to the spray jets.

5. A method as claimed in claim 3, in which more than two elongate members travel simultaneously through the spray zone, each elongate member is treated by a separate spray jet, and each elongate member is displaced in a temperature dependent manner perpendicularly to the spray jet treating it.

6. A method as claimed in claim 3, in which the tension of the elongate member is adjusted to a predetermined nominal value at least over the length travelling through the spray zone.

7. A method as claimed in claim 6, in which the control quantity required for adjusting the value of the tension to the nominal value is detected by measuring the amplitude of the vibration of the elongate member produced under the effect of the spray jet.

8. A method as claimed in claim 7, in which the back pressure of an air stream directed at the elongate member in the plane of oscillation thereof is measured for the purpose of adjusting the value of the tension to the nominal value.

9. A method as claimed in claim 3, in which the elongate member is diverted outside the spray zone and is guided at least once again through the spray zone.

10. A method as claimed in claim 9, in which at least one run of the elongate member diverted outside the spray zone is cooled.

11. A method as claimed in claim 9, in which the elongate member is partly twisted within the elastic range prior to a repeated passage through the spray zone.

12. A method as claimed in claim 10, in which a plurality of runs of the elongate member are guided simultaneously through the spray zone, and in which, for the purpose of focussing the spray jet treating them, the runs are collected into at least one group and are guided in the operative spray field in a plurality of planes disposed perpendicular to the direction of spraying and at such mutual spacings that, considered in the direction of the spray jet, the runs deflect the spray medium of the spray jet partly in the direction of the other runs associated with this group.

* * * * *